US009822987B2

(12) United States Patent
Gwen

(10) Patent No.: US 9,822,987 B2
(45) Date of Patent: Nov. 21, 2017

(54) DEHUMIDIFIER CONTAINER

(71) Applicant: CORE PACIFIC, LLC, Houston, TX (US)

(72) Inventor: Patrick Gwen, Houston, TX (US)

( * ) Notice: Subject to any disclaimer, the term of this patent is extended or adjusted under 35 U.S.C. 154(b) by 0 days.

(21) Appl. No.: 14/664,835

(22) Filed: Mar. 21, 2015

(65) Prior Publication Data

US 2016/0273789 A1 Sep. 22, 2016

(51) Int. Cl.
*F24F 3/14* (2006.01)
*B65D 47/32* (2006.01)
*B65D 81/26* (2006.01)

(52) U.S. Cl.
CPC ..... *F24F 3/1411* (2013.01); *B65D 47/32* (2013.01); *B65D 81/266* (2013.01)

(58) Field of Classification Search
CPC ..... B65D 25/04; B65D 47/32; B65D 81/266–81/268; F24F 3/1411
USPC ..... 206/204
See application file for complete search history.

(56) References Cited

U.S. PATENT DOCUMENTS 2,495,619 A * 1/1950 Weierman ..... F24F 3/1411 96/119
2,575,234 A * 11/1951 Race ..... F24F 3/1411 96/117.5
2,592,162 A 4/1952 Luce
3,142,830 A 7/1964 Esposito
5,215,561 A * 6/1993 Cameron ..... B01D 53/261 96/119
6,257,401 B1 * 7/2001 Mangla ..... B65D 21/0223 206/204
6,931,755 B1 * 8/2005 Hsu ..... B01D 53/261 34/218
8,783,491 B2 * 7/2014 Fu ..... B08B 13/00 220/23.89
2013/0213828 A1 8/2013 Chatterjee
2013/0269293 A1 10/2013 Dowling

* cited by examiner

*Primary Examiner* — Robert Poon
(74) *Attorney, Agent, or Firm* — Andrew W. Chu; Craft Chu PLLC

(57) ABSTRACT

The dehumidifier container for storing desiccant includes a storage compartment and a holding compartment. The storage compartment has side walls and a bottom base to form a top opening with attachment devices. The attachment devices allow release of the storage compartment from the container for disposal of collected water without disturbing the desiccant material in the holding compartment. The holding compartment has a housing with openings along the bottom edge, a bottom panel, and a top panel with a vent. The bottom panel has a funnel portion and a drain outlet. Air flows through the vent of the top panel and openings of the housing. Fluid collected by the desiccant drains through the bottom panel to the storage compartment. There is a filter between the funnel portion and the drain outlet to maintain the desiccant in the holding compartment, while only fluid collects in the storage compartment.

14 Claims, 5 Drawing Sheets

DEHUMIDIFIER CONTAINER

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to a dehumidifier for a room. More particularly, the present invention relates to a container for storing a desiccant material, filtering fluid collected by the desiccant material, and storing the collected fluid separate from the desiccant material. Even more particularly, the present invention relates to a dehumidifier container that detaches a compartment for disposing collected water for continued use of the desiccant material in the holding compartment.

2. Description of Related Art Including Information Disclosed under 37 CFR 1.97 and 37 CFR 1.98.

Desiccants by adsorption collect water on the surface of the desiccant compound. Desiccants by absorption collect water within the desiccant compound. Adsorption results in a collection of water to be removed and drained from the surface of the desiccant material. In contrast, absorption results in expansion of the volume of the desiccant material. When desiccant materials are used to remove water and water vapor from the atmosphere to maintain a drier environment, the desiccant container must account for whether the desiccant material adsorbs to collect water or absorbs to expand in size. Silica gel, calcium sulfate, activated charcoal, and calcium chloride are known desiccant materials.

The basic container for desiccant includes a housing and a vapor permeable membrane. The housing and membrane hold the desiccant in place, while the membrane exposes the desiccant to moisture in the atmosphere. The desiccant removes water from the air, while remaining contained in the housing. For an adsorbent desiccant material, the water is collected on the desiccant material and must be drained from the container. For an absorbing desiccant material, the container must allow for expansion of volume by the desiccant material. Most housings allow placement of the desiccant material in various locations within a room or other enclosed space. There are known containers, such as jars to set upon counters and pouches to hang from a horizontal closet rod.

Many simple versions of a desiccant container are known. U.S. Pat. No. 2,592,162, issued to Luce on Apr. 8, 1952, discloses a hanging container for desiccant material suspended in the air. U.S. Pat. No. 3,142,830, issued to Esposito et al on Jul. 28, 1964, describes a container with an indicator for saturation of the desiccant material inside the container. The container is a traditional model for setting on a counter or shelf. Various specialized containers are disclosed for limited applications, such as air flow through a motor vehicle air conditioning system and coatings for packaging.

More recent publications relate to specialized desiccant containers. U.S. Publication No. 20130269293, published for Dowling on Oct. 17, 2013, describes a container for protein powder in a sealed jar. U.S. Publication No. 20130213828, published for Chatterjee et al on Aug. 22, 2013, discloses another specialized pill bottle with an attached structure to hold desiccant material.

Every desiccant container must still account for the storage of water. For desiccant materials, which absorb, the container must be expandable to account for the change in volume of the desiccant material. The water is stored in the desiccant material in that situation. For desiccant materials, which adsorb, the container must separate the collected water from the surface of the desiccant material for storage and eventual removal. The water is stored separate from the desiccant material in the container.

For continued use over longer periods of time, the collected water must be separated from the surface of the material so that the material can continue to collect water. The life span of the desiccant material can be extended by efficiently removing collected water from the surface. Containers must have storage accounting for this separation collected water. The storage can be periodically drained, so that the container can be re-used. The storage can be filled over and for re-filling of storage. Furthermore, disposable desiccant materials can be expensive with purchasing new amounts of desiccant and new containers every time. For longer lasting containers with re-fillable desiccant material, the ability to maintain the capacity of the desiccant to adsorb and removal of the water from the container are important considerations. The storage of a desiccant container for limited seasonal use can also affect the structure and form of the container.

Also for continued use over longer periods of time, equilibrium between the collected water and the exposed desiccant material should be avoided. When the same desiccant material is exposed to the same collected water, there can be a micro-environment where the collected water evaporates into the desiccant material, which re-collects the vapor and re-deposits the vapor as collected water over and over. The prior art systems maintain this micro-climate, which reduces the effectiveness of the desiccant material stored in the container. Just passive storing desiccant material is insufficient for a long-lasting and re-useable desiccant container.

It is an object of the present invention to provide an embodiment of a desiccant container to house desiccant material in a holding compartment.

It is an object of the present invention to provide an embodiment of a desiccant container with separate compartments for desiccant and water storage.

It is another object of the present invention to provide an embodiment of a desiccant container with a drainage connection between the holding compartment and a water storage compartment.

It is another object of the present invention to provide an embodiment of a desiccant container to filter collected fluid through the drainage connection between the holding compartment and a water storage compartment.

It is another object of the present invention to provide an embodiment of a desiccant container to prevent equilibrium between the collected water and the desiccant material.

It is yet another object of the present invention to provide an embodiment of a desiccant container with airflow through the holding compartment.

It is still another object of the present invention to provide an embodiment of a desiccant container that is reuseable.

It is an object of the present invention to provide an embodiment of a desiccant container that can be disassembled.

It is another object of the present invention to provide an embodiment of a desiccant container with removable perforated screen for exposure to atmosphere.

It is another object of the present invention to provide an embodiment of a desiccant container with a removable water storage compartment.

These and other objectives and advantages of the present invention will become apparent from a reading of the attached specifications and appended claims.

SUMMARY OF THE INVENTION

Embodiments of the dehumidifier container include a storage compartment, a holding compartment and a filter means. The desiccant material is contained in the holding compartment, and water from the desiccant material is collected in the storage compartment. The storage compartment includes side walls and a bottom base. A top opening is formed by the side walls opposite the bottom base, and there is a rim along the top edge of the side walls. Attachment means are distributed along the rim. The attachment means can distributed on all sides of the top opening. In an embodiment with a storage compartment and bottom base as generally rectangular, the attachment means would be distributed on all four sides. In an embodiment with a storage compartment and bottom base as generally cylindrical, the attachment means would be distributed equally along the circular circumference.

The holding compartment is comprised of a housing, a bottom panel, and a top panel. The desiccant material is contained in the holding compartment with the bottom panel being attached to one end of the housing and the top panel being attached to an opposite end of the housing. A vent means in the top panel and opening along a bottom edge of the housing allow air flow through the holding compartment. The bottom panel separates an interior of the holding compartment from an interior of the storage compartment because the attachment means latch the storage compartment to the lower edge of the housing of the holding compartment. The bottom panel has a funnel portion and a drain outlet so that fluid collected by the desiccant drains through the drain outlet and into the storage compartment. The filter means is placed between the funnel portion and the drain outlet so that only fluid, not desiccant, flows from the holding compartment to the storage compartment.

The holding compartment and the storage compartment have compatible shapes for alignment of the attachment means to the lower edge of the housing. The shape of the bottom panel is also compatible with a shape of the top opening for the separation of the compartments, even though the compartments are adjacent. Embodiments show the shapes as generally rectangular or round.

In embodiments of the invention, the top panel and the bottom edge of the housing are exposed to the atmosphere. Air flows through the top panel and through the bottom edge of the housing.

In embodiments of the invention, the bottom panel faces the top opening of the storage compartment. The bottom panel can be comprised of funnel portion and a drain outlet. The funnel portion can be conical with an angled surface or conical with a curved surface. The funnel portion extends from a perimeter of the bottom panel to the drain outlet in the middle of the bottom panel. With the curved surface, there is a convex side and a concave side, with the convex side facing toward the top opening. The bottom panel slants toward the filter means so as to drain fluid, such as water, along the bottom panel through the filter means. The filter means maintains desiccant material in the holding compartment, while collected water drains into the storage compartment from the holding compartment. Gravity assisted drainage allows the dehumidifier container to continue removing moisture from the air without further intervention. In some embodiments, the filter means is a perforated plate. The figures show a rectangular perforated plate, but other shapes would also be incorporated into the container. Other types of filter means include a permeable membrane for passing liquids and gas through to the storage compartment.

The connection of the top panel to the housing, the bottom panel to the housing, and the filter means to the bottom plate can be friction fit, snap fit or adhesive. The attachment means may also be mechanical latches from the storage compartment to the rim of the housing of the holding compartment. The bottom panel may also have a shoulder on the funnel portion to engage the filter means. In some embodiments, the bottom base of the storage compartment is also removable from the side walls. The embodiments of the present invention channel collected water to the storage compartment and allow removal of the storage compartment without disrupting the holding compartment.

DETAILED DESCRIPTION OF THE DRAWINGS

Referring to FIGS. 1-8, embodiments of the dehumidifier container 10, 110 store desiccant material, which removes moisture from the atmosphere. The dehumidifier container 10, 110 can be placed in an enclosed space, such as a closet or even a large room. There must be exposure of the desiccant material to the air, such that the dehumidifier container 110 can be set on a flat surface, such as a counter, or suspended from a hanger or closet rod. FIGS. 1-2 and 5-6 show embodiments of the container 10 as a box with a generally rectangular shape. FIGS. 3-4 and 7-8 show other embodiments of the container 110 as a cylinder with a generally round shape.

Figure 1:
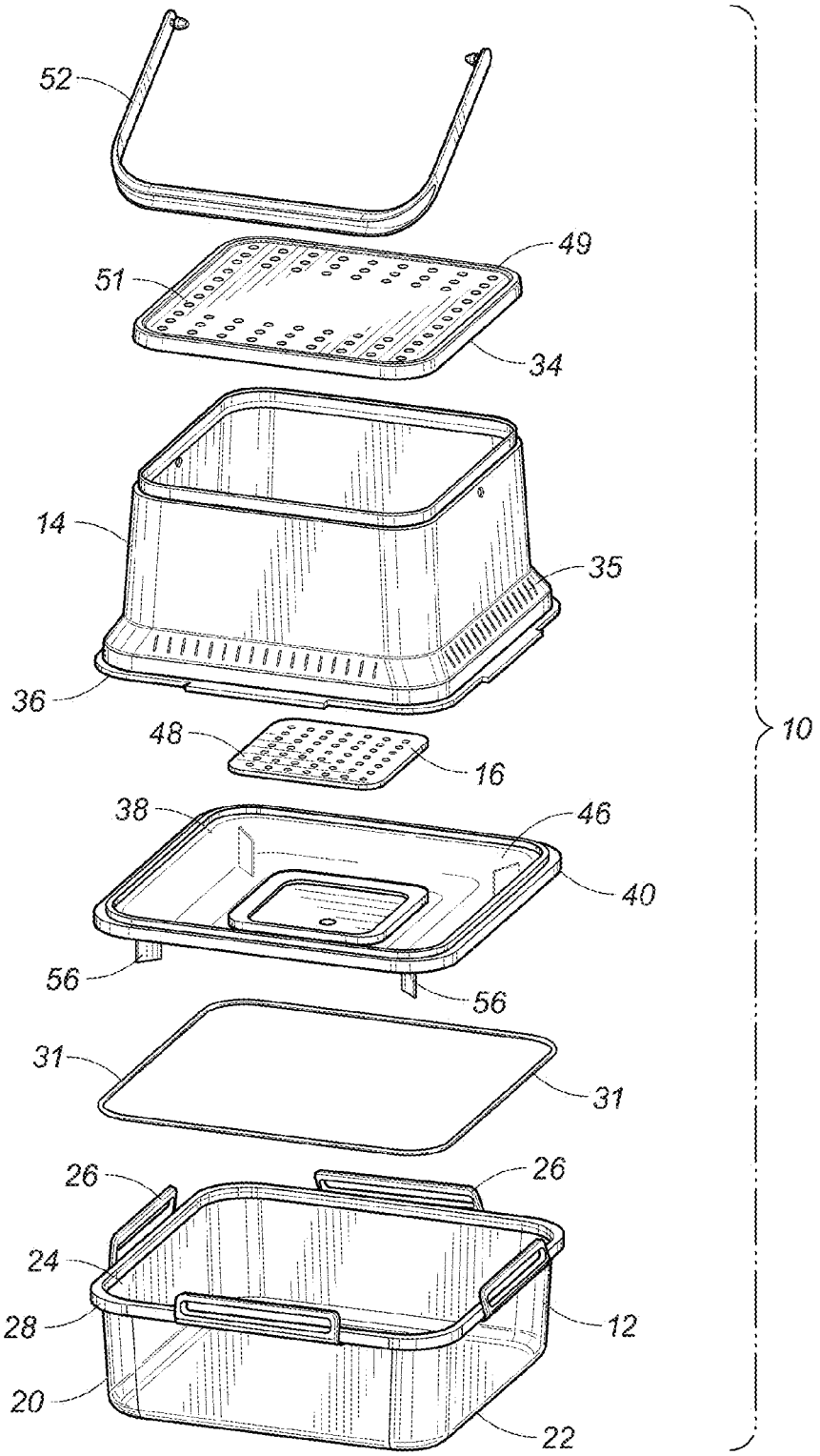
FIG. 1 is an exploded perspective view of an embodiment of the dehumidifier container for storing a desiccant material, according to the present invention.
Figure 2:
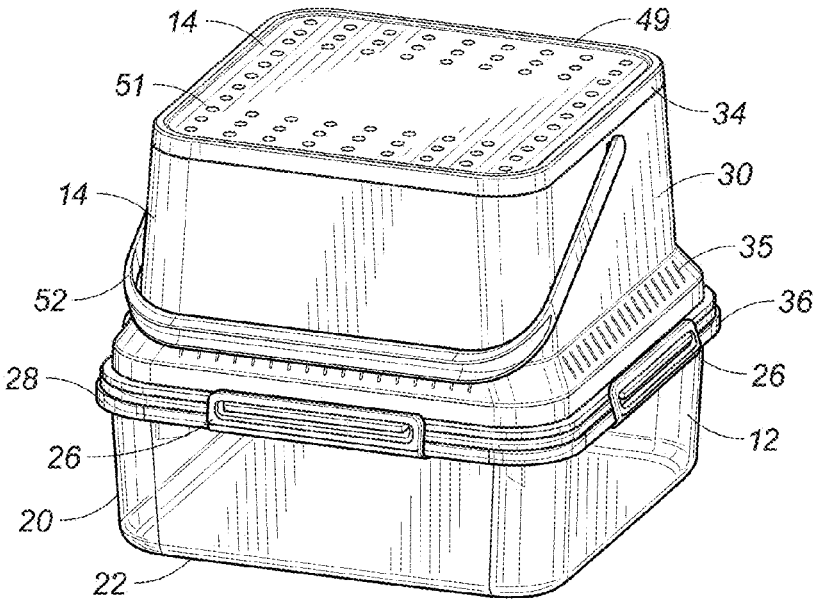
FIG. 2 is an assembled perspective view of the embodiment of FIG. 1, showing a dehumidifier container for storing a desiccant material, according to the present invention.

The embodiments of the dehumidifier container 10 include a storage compartment 12, a holding compartment 14, and a filtering means 16. FIGS. 1-2 and 5-6 show the storage compartment 12 having side walls 20 and a bottom base 22. The side walls 20 form a top opening 24 opposite the bottom base 22. The bottom base 22 has a flat surface to anchor the container 10 on a counter top. The top opening 24 has a rim 28 along a top edge of the side walls 20. The storage compartment 12 also includes an attachment means 26. The figures show the embodiment of the attachment means 26 as latches. The attachment means 26 are distributed along the rim 28. The embodiment of FIGS. 1-2 show a generally rectangular or box shape of the storage compartment 12, so the four sides of the bottom base 22 each have an attachment means 26. For other shapes of the storage compartment 12, more attachment means 26 may be used for adequate support around the top opening 24. A cylindrical shape or oblong shape could have a different distribution of attachment means 26.

Figure 3:
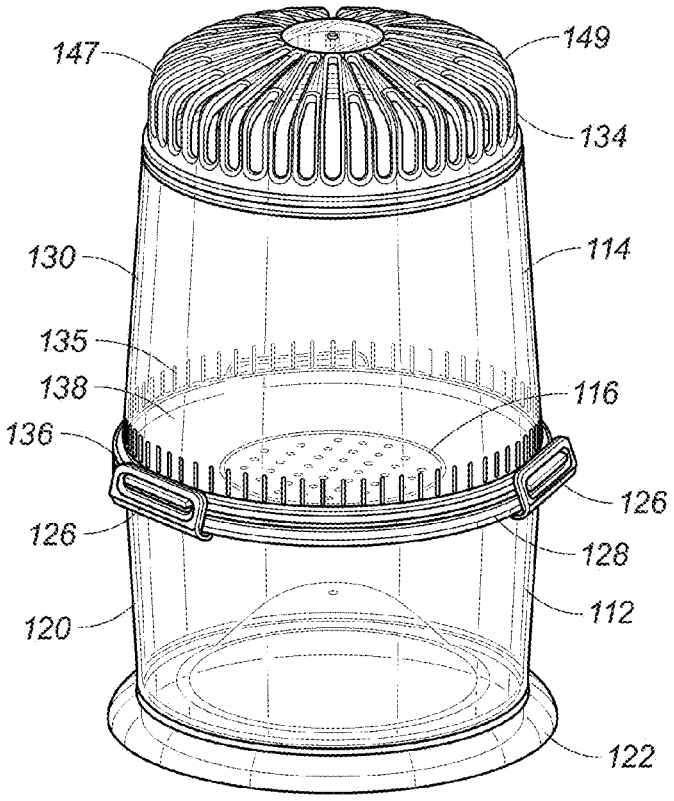
FIG. 3 is an exploded perspective view of another embodiment of the dehumidifier container for storing a desiccant material, according to the present invention.
Figure 4:
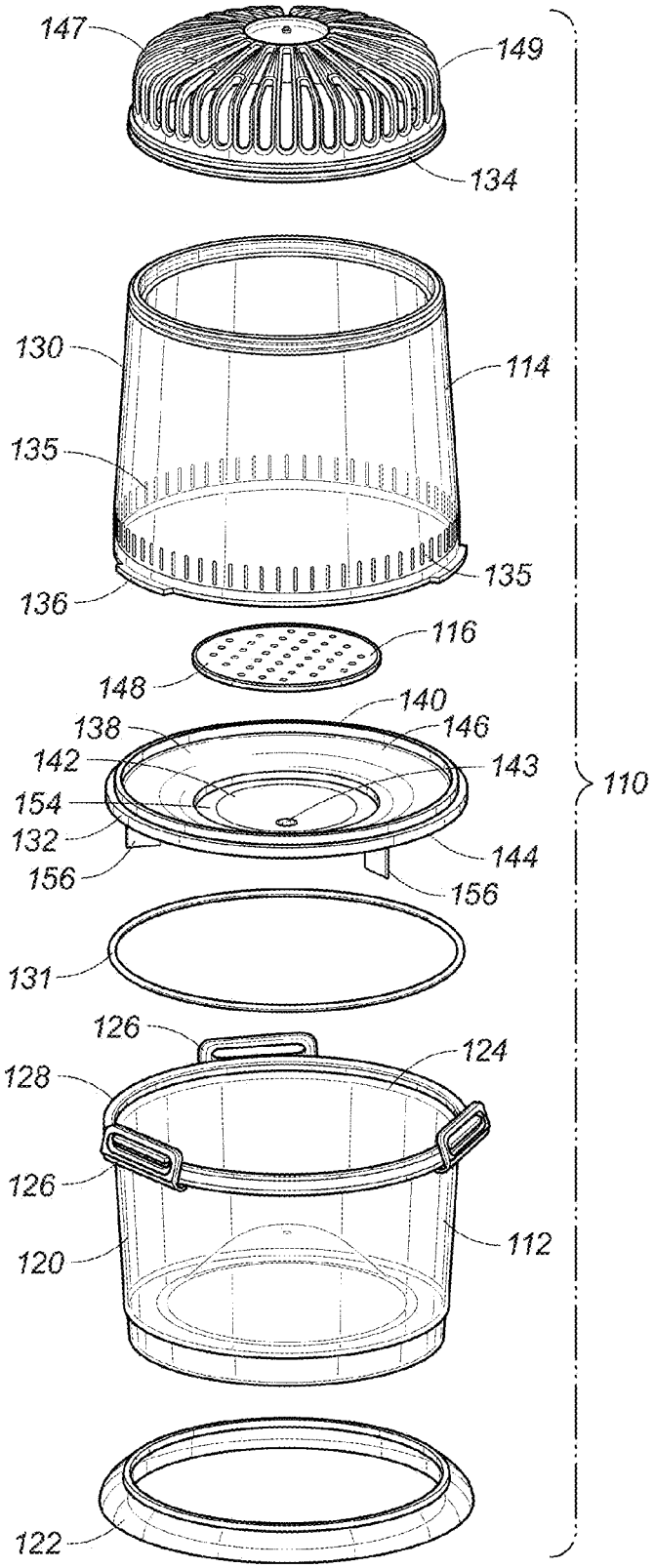
FIG. 4 is an assembled perspective view of the embodiment of FIG. 3, showing a dehumidifier container for storing a desiccant material, according to the present invention.

FIGS. 3-4 show embodiment of the container 110 with a storage compartment 112 having side walls 120 and a bottom base 122. The side walls 120 form a top opening 124 opposite the bottom base 122. The top opening 124 has a rim 128 along a top edge of the side walls 120, which is round. The attachment means 126 are also shown as latches. The attachment means 126 are distributed along the rim 128 equidistant from each other around the circular perimeter. FIG. 3 shows three latches but other variations in number of attachment means 126 are possible. FIG. 3 also shows the bottom base 122 as detachable from the side walls 120. The bottom base 122 is also shown with a protrusion into the storage compartment 112, which can direct fluid flow toward the deeper part of the storage compartment 112. For emptying the storage compartment 112, the bottom base 122 can be removed. The bottom base 122 can be removeably engaged to the side walls 120 by friction fit, snap fit or adhesive. The bottom base 122 is sealed liquid tight to the side walls 120 so as to contain fluid, such as water, without leaking.

FIGS. 1-2 show the holding compartment 14 being comprised of a housing 30, a bottom panel 32, and a top panel 34. The holding compartment 14 has a shape compatible with a shape of the storage compartment 12. The bottom panel 32 attaches to one end of the housing 30, while the top panel 34 attaches to an opposite end of the housing 30. Relative to the storage compartment 12, the bottom panel 32 faces the top opening 24. The attachment means 26 removeably engage a lower edge 36 of the housing 30. The holding compartment 14 is attached but the interior of the holding compartment 14 is separate from the storage compartment 12. The bottom panel 32 is the divider between an interior of the holding compartment 14 and an interior of the storage compartment 12. As such, the top opening 24 aligns with the lower edge 36 of the housing 30. The shapes of the top opening 24 and the bottom panel 32 must be compatible for this alignment with the lower edge 36 of the housing 30. FIGS. 1-2 show the housing 30 with a plurality of openings 35 along the lower edge 36. The plurality of openings 35 are vents for air flow through the housing 30. There is also a lipped edge for engaging the attachment means 26 of the storage compartment 12 in FIGS. 1-2 and 5-6. The lipped edge and attachment means 26 are complementary for fixed engagement. There is also an O-ring 31 between the bottom panel 32 and the top opening 24 for a water tight seal.

FIGS. 3-4 show another embodiment of the holding compartment 114 with a round shape being comprised of a housing 130, a bottom panel 132, and a top panel 134. The holding compartment 114 has a shape compatible with a shape of the storage compartment 12, which is also round to form a generally cylindrical container 110. The bottom panel 132 still attaches to one end of the housing 130, while the top panel 134 attaches to an opposite end of the housing 130. There is the same separation of the interior of the holding compartment 114 and the interior of the storage compartment 112. The housing 130 is also shown with a plurality of openings 135 along the lower edge 136. The plurality of openings 135 are vents for air flow through the housing 130. FIGS. 3-4 show the housing 130 with a tabbed edge for engaging the attachment means 126 of the storage compartment 112. The tabs of the tabbed edge and attachment means 126 are complementary for fixed engagement. FIGS. 3-4 also show an embodiment with an O-ring 131 friction fit between the bottom panel 132 and the top opening 124 of the storage compartment 112 so as to form a liquid tight seal. Liquid only passes through the filter means 116 and the drain outlet 142.

Figure 5:
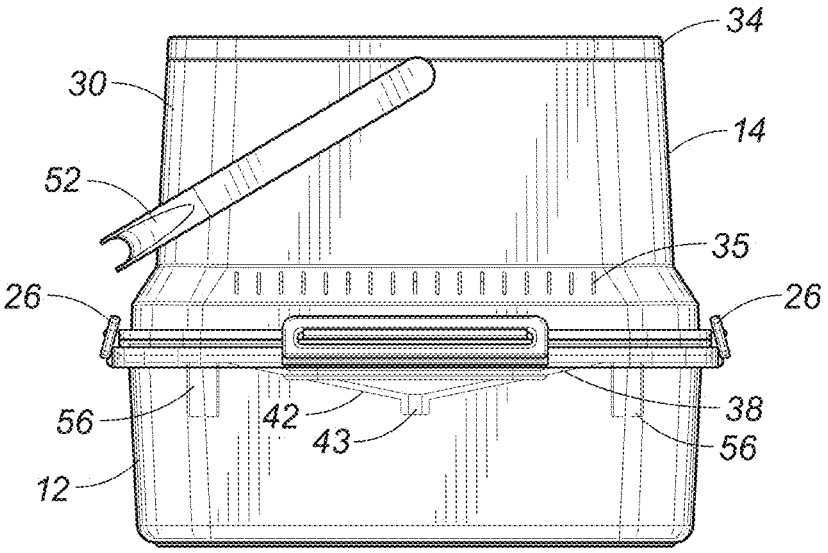
FIG. 5 is a front elevation view of the embodiment of FIGS. 1 and 2.

Several embodiments of the bottom panel 32 include a funnel portion 38 and a drain outlet 42. FIG. 5 shows a side elevation view of the bottom panel 32. The funnel portion 38 extends from a perimeter 40 of the bottom panel 32 to the drain outlet 42. The funnel portion 38 is generally conical to channel liquid to the drain outlet 42. In some embodiments, the funnel portion 38 has an angled surface as a cone, and the drain outlet 42 includes a tubular member 43. The tubular member 43 extends downward into the storage compartment 12. In other embodiments, the funnel portion 38 can have a curved surface, forming a convex side 44 and a concave side 46. The convex side 44 faces toward the top opening 24. The bottom panel 32 channels collected water in the holding compartment to drain outlet 42 at a bottom of the bottom panel 32. The filtering means 16 is placed between the funnel portion 38 and the drain outlet 42, so that desiccant material remains in the holding compartment 14 and only water or fluid passes through the filter means 16 to the storage compartment 12.

FIG. 1 shows the funnel portion 38 with a curved surface as an inverted generally rectangular cone from the perimeter 40 to sides of the drain outlet 42. The filtering means 16 is also generally rectangular so as to be compatible with the shape of the bottom panel 32. One embodiment is the filtering means 16 as generally rectangular, so that the curved surface of the funnel portion 38 must be compatibly contoured to channel the water to the bottom of the bottom panel 32. FIGS. 1 and 5 also show a plurality of pegs 56 extending downward from the convex side 44 of the funnel portion 38. The pegs 56 support the bottom panel 32 when disassembled from the housing 30. The pegs 56 level the bottom panel 32 for sitting on a flat surface. The bottom panel 32 is not flat because of the funnel portion 38 and drain outlet 42 extending downward, so the bottom panel 32 cannot stably rest on a flat surface. The pegs 56 level the bottom panel 32 when separated from the housing 30. There are also pegs 156 in the embodiment of FIG. 3 and FIG. 7, supporting the bottom panel 132 with a circular shape. The pegs 156 support the inverted cone shape on a flat surface.

Figure 7:
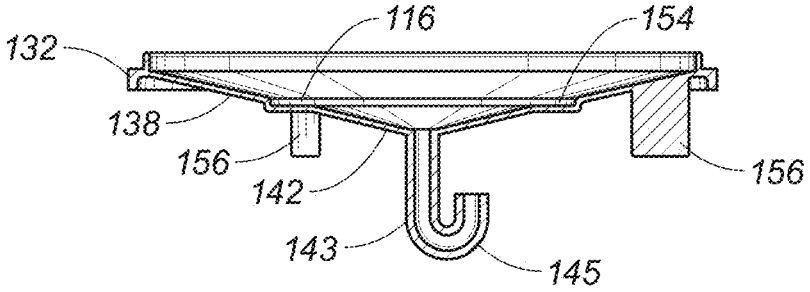
FIG. 7 is cross-sectional view of an embodiment of the bottom panel of the holding compartment, according to the embodiment of FIG. 3 for a round shaped housing.

FIGS. 3-4 and 7-8 show the embodiment of the container 110 with the round shape. There is the bottom panel 132 including a funnel portion 138 and a drain outlet 142 in FIG. 7. The funnel portion 138 is round, showing a conventional funnel shape, which extends from a circular perimeter 140 of the bottom panel 132 to the drain outlet 142. The funnel portion 138 remains generally conical to channel liquid to the drain outlet 142. Similar to the previous embodiment, the surface of the funnel portion 138 can be angled, slanted or curved. There is also a convex side 144 and a concave side 146 to the funnel portion 138. Collected water from the desiccant material drains along the funnel portion 138 and through the drain outlet 142. The filtering means 116 is placed between the funnel portion 138 and the drain outlet 142. The filtering means 116 is also generally circular so as to be compatible with the shape of the bottom panel 132. The variation of FIG. 7 shows the drain outlet 142 comprised of a tubular member 143 with a generally U-shape portion 145 to prevent back flow. Very little collected water can back flow into the holding compartment 114 when the container 110 is inverted or tipped from vertical. The tubular member 143 with U-shaped portion 145 more securely separates the storage compartment 112 from the holding compartment 114.

Figure 6:
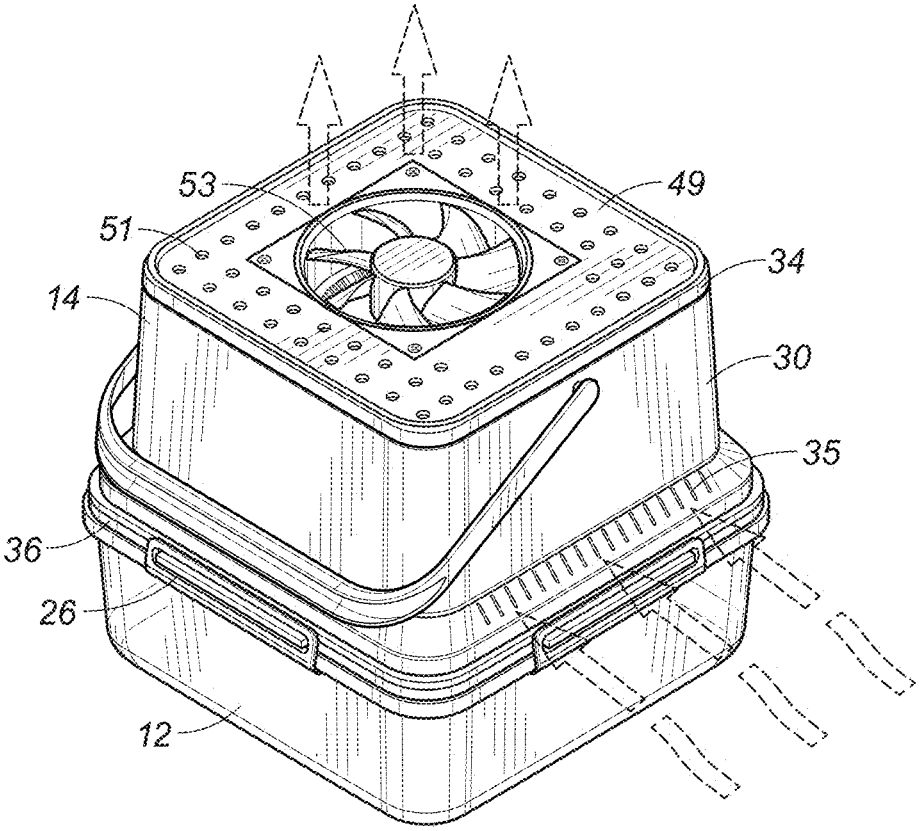
FIG. 6 is an assembled perspective view of still another embodiment of the dehumidifier container with an alternate top panel on a generally rectangular housing.

FIGS. 1-2 show embodiments of the top panel 34. There is a vent means 49, shown as a plurality of holes 51 in the top panel 34 to allow exposure of desiccant material in the holding compartment 14 to air. Moisture entering through the top panel 34 collects on the surface of the desiccant material, and the collected moisture is water drained through the filtering means 16 to the storage compartment 12. FIG. 6 shows an alternative embodiment of the vent means 49 being comprised of a fan insert 53. FIG. 6 also shows the dynamic air flow through the openings 35 of the housing 30 and through the vent means 49. A motorized fan insert 53 can actively control air flow through the housing 30 from the top panel 34 and through the openings 35 at the bottom edge of the housing 30. The arrows in FIG. 6 represent air flow through the holding compartment 14. Embodiments of FIGS. 1-2 show a handle 52 pivotally attached to the holding compartment 14. The handle 52 can support the container 10 for hanging or for carrying during transport.

Figure 8:
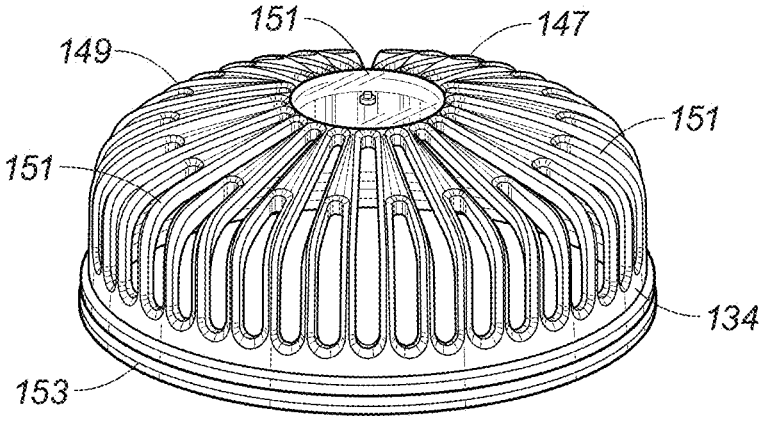
FIG. 8 is another upper perspective view of an embodiment of the top panel of the holding compartment, according to the embodiment of FIG. 3 for a round shaped housing.

FIGS. 3-4 and 8 show embodiments of the top panel 134. There is a vent means 149, shown as a grated lid 147 in the top panel 134 to allow exposure of desiccant material to the atmosphere. The grated lid 147 can be comprised of a plurality of raised ribs 151 extending upward from a lip 153 of the grated lid to a center position. A circular opening 155 is formed at a top of the grated lid 147. Desiccant material is exposed to the moisture in the air, and the grated lid 147 keeps desiccant material within the holding compartment 114. The embodiment of FIGS. 3-4 and 8 should remain upright. Air flows through the housing 130 from the top panel 134 and any vent means 149 and through the openings 135 at the bottom edge of the housing 130.

Embodiments of the filtering means 16 in FIGS. 1-2 show a fluid connection between the holding compartment 14 and the storage compartment 12. Desiccant material stored in the holding container adsorbs water, and the collected water drains from the holding compartment 14 through the filtering means 16 to the storage compartment 12. The filtering means 16 insures that the desiccant material remains stored in the holding compartment 14 and other water passes through to the storage compartment 12. FIG. 1 shows one embodiment of the filtering means 16 as a perforated plate 48 mounted between the funnel portion 38 and the drain outlet 42 of the bottom panel 32. FIG. 1 shows a shoulder 54 for holding the filtering means 16. The perforated plate 48 has holes to allow water to pass through the holding compartment 14 to the storage compartment 12. The generally rectangular shape affects the funnel portion 38 for channeling water from the desiccant material in the holding compartment 14. Alternatively, the filtering means 16 can be comprised of a permeable membrane or other structure or other material to allow passage of water without passage of solid desiccant material. FIGS. 3 and 7 show another embodiment of the filtering means 116 as a perforated plate 148 with a circular shape. The funnel portion 138 still channels water through the drain outlet 142 in a more conventional round cone shape. The placement of the perforated plate 148 is friction fit on a shoulder 154 between the funnel portion 138 and the drain outlet 142.

The connections between the top panel 34, 134 and the housing 30, 130 between the bottom panel 32, 132 and the housing 30, 130 and the filtering means 16, 116 to the bottom panel 32, 132 can be either friction fit, snap fit or adhesive, in FIGS. 1-8. FIG. 2 shows a snap fit of the top panel 34 and the housing 30, as the top panel 34 sets in upper edges of the housing 30. The fixed engagement of the perforated plate 48 to the bottom panel 32 is shown in FIG. 1 as friction fit. A shoulder 54 engages the perforated plate 48 so that the perforated plate 48 mounts in the bottom panel 32. FIGS. 3 and 7 also show the shoulder 154 engaging the perforated plate 148 having a circular shape. Alternatively, there can be a water tight seal between the perforated plate 48, 148 and the bottom panel 32, 132 so that water only passes through the holes of the perforated plate 48, 148 instead of leaking through the seams of connection to the bottom panel 32, 132. When the container 10, 110 is assembled or disassembled, the fixed engagements are broken and reset. For adhesive attachment, adhesives would be cleaned and re-applied.

The attachment means 26, 126 of FIGS. 1-4 show friction fit engagement. The connections are water tight to prevent leakage between compartments. The container can be jostled and sometimes inverted. FIGS. 1 and 2 show embodiments with a latch for holding the storage compartment 12 to the holding compartment 14. FIGS. 3 and 4 show embodiments with a tabbed edge on the holding compartment 114. The storage compartment 12, 112 is removable without disturbing the desiccant material in the holding compartment 14, 114. The collected water can be disposed and the storage compartment 12, 112 can be re-attached so that the desiccant material can continue to remove moisture without replacing the entire container 10, 110. There are O-rings 31, 131 for additional water tight sealing between the holding compartment 14, 114 and the storage compartment 12, 122, respectively. The storage compartment 12, 112 is re-useable for more water. Also, the holding compartment 14, 114 is re-useable for more desiccant material. When the desiccant material is no longer active, the housing 30, 130 can be opened by removal of the top panel 34, 134 or bottom panel 32, 132. The desiccant material can be removed and replaced.

The present invention provides a dehumidifier container for storing a desiccant material in a holding compartment, separate from a storage compartment for water. The container stores adsorbing desiccant material and prolongs the active life of the desiccant by channeling the collected water away from the desiccant material. The top panel can have vents to expose the adsorbing desiccant material to the atmosphere. These vents can be passive holes or openings or active devices, such as a fan. Equilibrium between collected water and the desiccant material is avoided by the air flow provided by the present invention. Openings at the bottom edge of the housing continually expose the desiccant material to new air, instead of just the air above the collected water. The vent means further increase the air flow and amount of new exposure. The passive porous separation between the desiccant material and the water of the prior art is avoided. The holding compartment preserves the desiccant material for continued use, while the storage compartment removes and disposes collected water away from the desiccant material. The storage compartment can be re-used to hold more water so that the desiccant material can continue collecting. Furthermore, the holding compartment can be re-used to hold more desiccant material when the adsorbing desiccant material finally expires. The desiccant container can be assembled and disassembled with the parts being friction fit or snap fit together. The present invention also provides an embodiment of a desiccant container with a drainage connection between the holding compartment and a water storage compartment. The collected water is filtered between the funnel portion and the drain outlet. Only collected water, not desiccant material passes through to the storage compartment. The storage compartment can be removed and emptied so that more water can be collected.

The foregoing disclosure and description of the invention is illustrative and explanatory thereof. Various changes in the details of the illustrated structures, construction and method can be made without departing from the true spirit of the invention.

I claim:

1. A dehumidifier container comprising:

a storage compartment being comprised of a bottom base and side walls, said side walls forming an interior volume and a top opening opposite said bottom base, said storage compartment being comprised of means for attaching to said top opening, said means for attaching being distributed along said side walls, wherein said top opening has a rim along top edges of said side walls, said means for attaching being fixed to said rim;

a holding compartment being comprised of a housing, a bottom panel, and a top panel, said housing have a plurality of openings along a bottom edge thereof, said bottom panel being attached to one end of said housing, said top panel being attached to an opposite end of said housing, said bottom panel facing said top opening of said storage compartment, said means for attaching removeably engaging a lower edge of said housing, said holding compartment having a shape compatible with a shape of said storage compartment, said rim of said top opening being aligned with said lower edge of said housing, wherein said bottom panel comprises a funnel portion and a drain outlet, said funnel portion extending from a perimeter of said bottom panel to said drain outlet, said bottom panel separating an interior of said holding compartment from an interior of said storage compartment; and a means for filtering positioned between said funnel portion and said drain outlet of said bottom panel, wherein fluid connection from said holding compartment to said storage compartment passes through said means for filtering, wherein said means for filtering is comprised of a perforated plate, wherein said funnel portion of said bottom panel is comprised of a shoulder, said shoulder engaging said means for filtering, and wherein fixed engagement of said perforated plate to said bottom panel is selected from a group consisting of friction fit, snap fit and adhesive, said fixed engagement being a water tight seal.

2. The dehumidifier container, according to claim 1, said drain outlet being comprised of a tubular member with a generally U-shaped curvature.

3. The dehumidifier container, according to claim 1, wherein said funnel portion is curved, said bottom panel having a convex side and a concave side, said convex side facing toward said top opening.

4. The dehumidifier container, according to claim 1, said funnel portion of said bottom panel being comprised of a plurality of pegs extending downward from a convex side of said bottom panel so as to support said bottom panel when disassembled from said housing.

5. The dehumidifier container, according to claim 1, wherein fixed engagement of said bottom panel to said one end of said housing is selected from a group consisting of friction fit, snap fit and adhesive.

6. The dehumidifier container, according to claim 1, wherein said means for filtering is comprised of a permeable membrane.

7. The dehumidifier container, according to claim 1, wherein said top panel is comprised of a means for venting, said holding compartment being in fluid connection with atmosphere outside of said housing, said means for venting being comprised of at least one of a group consisting of a plurality of holes, a grated lid and a fan insert.

8. The dehumidifier container, according to claim 7, wherein said means for venting is comprised of a fan insert, and wherein said fan insert is comprised of a motor and a plurality of fan blades actuated by said motor, said plurality of openings and said means for venting being in fluid connection for air flow.

9. The dehumidifier container, according to claim 1, further comprising:

a handle pivotally attached to said holding compartment.

10. A dehumidifier container for storing desiccant material, comprising:

a storage compartment being comprised of a bottom base and side walls, said side walls forming an interior volume and a top opening opposite said bottom base, said storage compartment being comprised of means for attaching to said top opening, said means for attaching being distributed on all sides of said top opening, wherein said top opening has a rim along top edges of said side walls, said means for attaching being fixed to said rim;

a holding compartment being comprised of a housing, a bottom panel, and a top panel, said housing have a plurality of openings along a bottom edge thereof, said bottom panel being attached to one end of said housing, said top panel being attached to an opposite end of said housing, said bottom panel facing said top opening of said storage compartment, said means for attaching removeably engaging a lower edge of said housing, wherein said bottom panel comprises a funnel portion and a drain outlet, said funnel portion having an angled surface extending from a perimeter of said bottom panel to said drain outlet, said funnel portion being generally conical, said bottom panel separating an interior of said holding compartment from said interior volume of said storage compartment, and wherein said top panel is comprised of a means for venting, said holding compartment being in fluid connection with atmosphere outside of said housing; and a means for filtering positioned between said funnel portion and said drain outlet of said bottom panel, wherein fluid connection from said holding compartment to said storage compartment passes through said means for filtering, wherein said means for filtering is comprised of a perforated plate, wherein said funnel portion of said bottom panel is comprised of a shoulder, said shoulder engaging said means for filtering, and wherein fixed engagement of said perforated plate to said bottom panel is selected from a group consisting of friction fit, snap fit and adhesive, said fixed engagement being a water tight seal.

11. The dehumidifier container, according to claim 10, said holding compartment having a shape compatible with a shape of said storage compartment, said rim of said top opening being aligned with said lower edge of said housing, and wherein said means for venting comprises at least one of a group consisting of a plurality of holes, a grated lid and a fan insert.

12. The dehumidifier container, according to claim 10, wherein said drain outlet is comprised of a tubular member extending downward from said bottom panel so as to prevent back flow from said storage compartment to said holding compartment.

13. The dehumidifier container, according to claim 1, wherein said funnel portion is curved, said bottom panel having a convex side and a concave side, said convex side facing toward said top opening, and wherein said funnel portion comprises a plurality of pegs extending downward from a convex side of said bottom panel so as to support said bottom panel when disassembled from said housing.

14. The dehumidifier container, according to claim 1, further comprising:

a handle pivotally attached to said holding compartment.

* * * * *